United States Patent [19]

Van Der Linden

[11] 4,372,287

[45] Feb. 8, 1983

[54] WOOD-BURNING STOVE AND METHOD FOR BURNING WOOD

[76] Inventor: Roy E. Van Der Linden, 3115 Sam's Creek Rd., New Windsor, Md. 21776

[21] Appl. No.: 198,191

[22] Filed: Oct. 17, 1980

[51] Int. Cl.[3] ..... F24B 5/00; C10B 1/06

[52] U.S. Cl. ..... 126/79; 126/77; 126/149; 126/242; 202/136

[58] Field of Search ..... 126/79, 108, 69, 73, 126/74, 75, 77, 149, 145, 146, 151, 181, 163 R, 163 A, 99 D, 103, 242; 202/128, 133, 136

[56] References Cited

U.S. PATENT DOCUMENTS

| | | | |
|---|---|---|---|
| Re. 5,605 | 10/1873 | Widmann | 126/79 |
| 64,777 | 5/1867 | Lyons | 202/136 |
| 110,664 | 1/1871 | Martin | 126/79 |
| 129,534 | 7/1872 | Corse | 126/74 |
| 202,718 | 4/1878 | Gould | 126/74 |
| 372,359 | 11/1887 | Chalmers | 126/79 |
| 616,595 | 12/1898 | Wandel | 126/149 |
| 632,794 | 9/1899 | Spurrier | 202/133 |
| 687,549 | 11/1901 | Wilson | 126/149 |
| 706,097 | 8/1902 | Oney | 126/79 |
| 732,186 | 6/1903 | Hill | 126/149 |
| 777,187 | 12/1904 | Doughty | 126/79 |
| 835,747 | 11/1906 | Brown | 202/128 |
| 837,320 | 12/1906 | Menkey | 126/79 |
| 966,200 | 8/1910 | Harrigan | 126/149 |
| 1,132,875 | 3/1915 | Pemberton | 126/79 |
| 1,629,223 | 5/1927 | Mogyoro's et al. | 126/79 |
| 3,171,399 | 3/1965 | Kirgan | 126/69 |
| 3,933,145 | 1/1976 | Reich | 126/79 |
| 4,098,254 | 7/1978 | Böse | 126/79 |

FOREIGN PATENT DOCUMENTS

| | | | |
|---|---|---|---|
| 526781 | 10/1921 | France | 126/79 |

*Primary Examiner*—Daniel J. O'Connor
*Attorney, Agent, or Firm*—Quaintance & Murphy

[57] ABSTRACT

A wood-burning stove utilizes a volatilization chamber inserted within the combustion chamber of the stove. The volatilization chamber contains a charge of wood which is heated to drive off combustible gases and vapors. The combustible gases and vapors are thereafter burned in the combustion chamber of the stove by being passed through a layer of solid fuel w hich includes a substantial amount of charcoal residue from previous volatilized wood. The heat generated by burning the volatile material is used to produce additional volatiles as well as to heat the stove.

4 Claims, 4 Drawing Figures

WOOD-BURNING STOVE AND METHOD FOR BURNING WOOD

BACKGROUND OF THE INVENTION

Throughout the world, wood is perhaps the most widely used fuel for cooking and heating and for heating is being used more and more in developed countries as an alternative to petroleum and natural gas. Wood is becoming more expensive, and, lately, considerable effort has been expended to increase the efficiency of wood-burning stoves so that they yield more heat per unit of wood burned and need to be recharged with less frequency. While burning wood, combustible volatiles are generated but only partially consumed. Some of the unburned volatiles escape up chimneys and contribute to air pollution while other volatiles condense as creosote on cool chimney surfaces and stove surfaces. The creosote can cause chimney fires or blockage and therefore must be periodically removed if one wishes to safely burn wood. In addition, a great deal of particulate matter becomes entrained in the stove exhaust contributing greatly to air pollution.

Modern wood-burning stoves are generally airtight with the exception of small controlled air inlets and are baffled in order to increase their efficiency. While the efficiency of these stoves is considerably enhanced, much of the combustible volatiles released by burning the wood is released into the atmosphere without being burned. In addition, these stoves produce almost as much smoke or particulate matter as fireplaces and stoves which are not airtight. The volatiles produced by airtight stoves also tend to condense on stove pipes and chimneys creating a fire hazard, and since they are not burned, the volatiles and particles do not contribute to the heat output of the stove.

SUMMARY OF THE INVENTION

In view of the aforementioned considerations, it is a feature of the instant invention to provide a new and improved wood-burning stove and a new and improved method of burning wood wherein there is substantially complete utilization of all combustible products, both volatile and solid.

In view of this feature, the instant invention contemplates a wood-burning stove having a first chamber for volatilization of the wood and a second chamber for combustion of the volatiles produced in the first chamber. The first chamber is substantially airtight, while the second chamber includes an air inlet. The combustion of the volatiles takes place beneath the first chamber so as to heat wood in the first chamber and thereby drive off additional volatiles.

In accordance with the method of the instant invention, wood is burned in a stove having a first chamber within a second chamber. The wood is heated in the first chamber in the absence of sufficient oxygen to cause combustion so as to drive volatiles from the wood. The volatiles are released into the second chamber which has sufficient air to ignite the volatiles. The ignited volatiles supply sufficient heat to continuously volatilize wood in the first chamber. After a substantial portion of the wood in the first chamber has been converted into a charcoal residue, the residue is dumped from the first chamber into the second chamber and is thereafter consumed during a subsequent burning cycle after the first chamber has been recharged with wood.

DESCRIPTION OF THE PREFERRED EMBODIMENT

Figure 1:
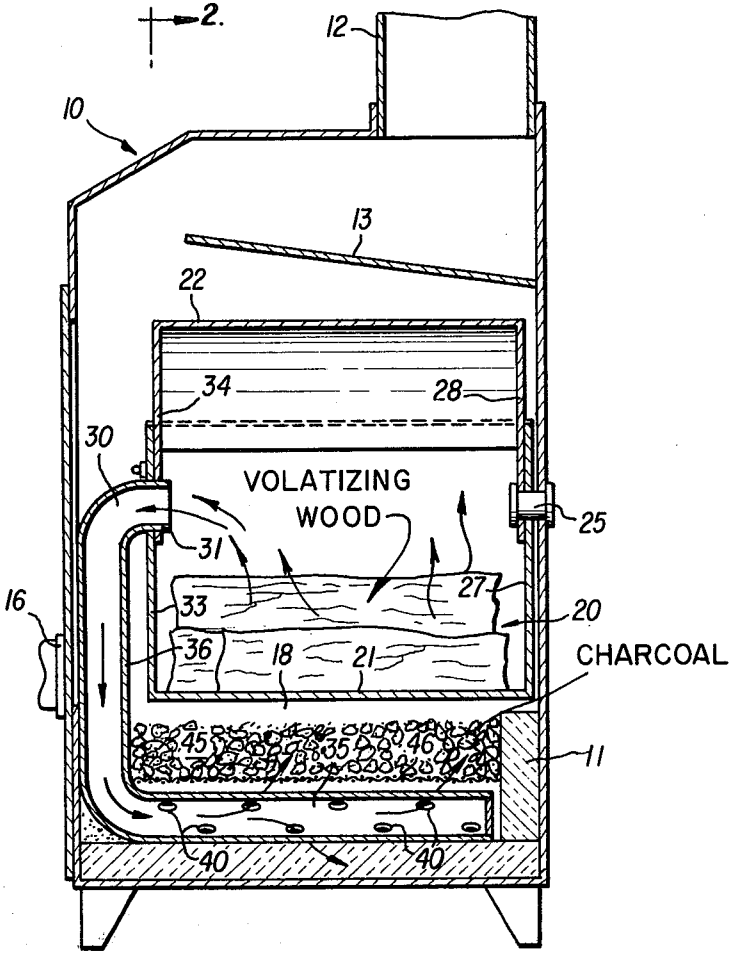
FIG. 1 is a side view, in section, showing a stove incorporating the features of the instant invention.
Figure 2:
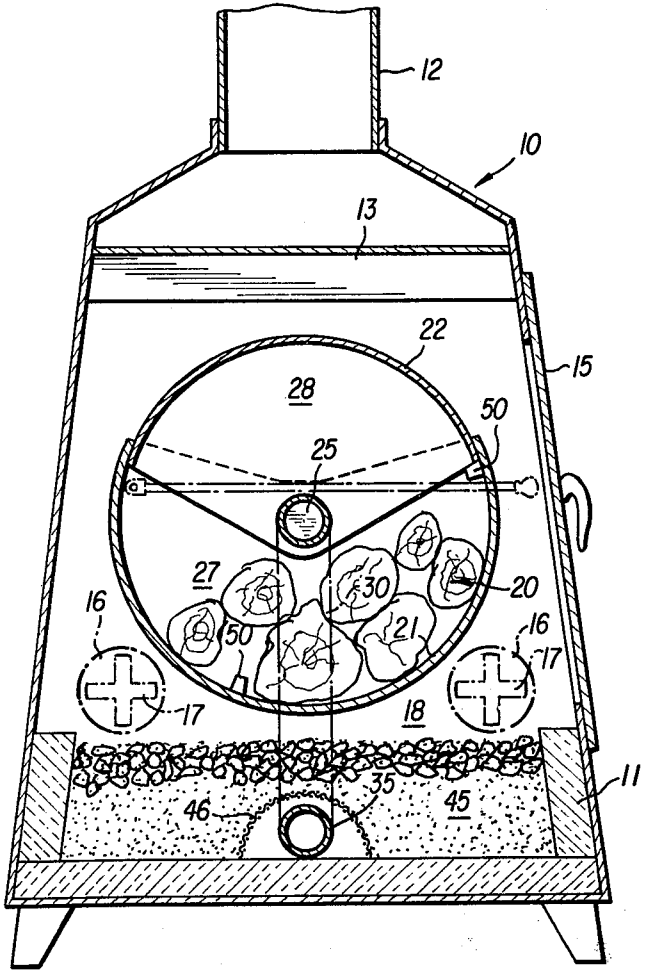
FIG. 2 is a front section taken along Lines 2—2 of FIG. 1.

Referring now to FIG. 1, there is shown a wood-burning stove designated generally by the numeral 10 which has a fire brick lining 11 and a chimney 12. The stove 10 may be of generally conventional structure and may include a baffle 13 to enhance its efficiency. As is seen in FIG. 2, the stove has a side opening door 15 for loading the stove 10 and for cleaning out the stove. Preferably, the stove has welded joints and is airtight with the exception of adjustable valves 16 which adjust the amount of air flowing through air intakes 17. The air intakes 17 communicate with a combustion chamber 18 in which volatiles produced by wood heated in the absence of air are burned, as will be further explained hereinafter.

Within the combustion chamber 18, there is a volatilization chamber designated generally by the numeral 20. In the illustrations, the volatilization chamber 20 is fixed within the combustion chamber; however, the volatilization chamber may be in the form of an insert which can be separately purchased and installed in an existing stove. In other words, there need be no mechanical connection between the volatilization chamber 20 and the stove 10. In the illustrated embodiment, the volatilization chamber 20 is formed by a pair of cylindrical segments 21 and 22. The segment 21 forms a receptacle for holding wood while the segment 22 forms a closure for the receptacle.

In the illustrated embodiment, the volatilization chamber 20 is supported rotatably on a bearing formed by an axle 25 which projects inwardly from the rear wall 26 of the stove 10. The receptacle 21 has a rear wall 27 through which the axle 25 passes and the cover 22 also has a rear wall 28 through which the axle 25 passes. Accordingly, the axle 25 forms a bearing which supports rotatably the rear ends of the receptacle 21 and cover 22. The front ends of the receptacle 21 and cover 22 are supported by a J-shaped pipe 30. One end 31 of the pipe 30 forms a bearing on which the front wall 33 of the receptacle 21 and the front wall 34 of the cover 22 are journaled. The long leg 35 of the pipe 30 rests on the fire brick floor of the stove 10 while the short leg 36 extends up to support the volatilization chamber 20.

The volatilization chamber 20 is not necessarily completely airtight due to the need for relative movement between the cover 22 and receptacle 21 and due to the rotatable mounting arrangement on pipe 30 and axle 25. However, the volatilization chamber 20 is substantially airtight in that it is tight enough so that a slight positive pressure therein will keep air from flowing into it. The pipe 30 forms an exhaust through which volatiles produced upon heating wood in the volatilization chamber 20 exit to the combustion chamber 18 formed by the interior of the stove 10. The long leg 35 of the pipe 30 has a series of vents 40 therein which are disposed beneath the volatilization chamber 20 so that gases and vapors driven off upon heating the wood in the chamber 20 exit beneath the chamber. A layer of solid fuel 45 preferably in the form of charcoal with perhaps a few sticks of unburned wood is placed over the long leg 35 and is perhaps kept slightly spaced thereby by a permeable member or screen 46 so as not to block the openings 40.

In operation, burning of the solid fuel 45 heats wood within the volatilization chamber 20 which drives off gases and vapors from the wood. The gases and vapors flow through the pipe 30 and exit beneath the solid fuel layer 45. The heat from the solid fuel 45 ignites the gases and vapors so that the gases and vapors burn in the combustion chamber 18. Some of the heat in the combustion chamber 18 is used to further volatilize wood in the volatilization chamber 20 while the remainder of the heat heats the inner surfaces of the stove 10. Heat on the inner surfaces of the stove 10 is conducted to the outer surfaces of the stove 10 and radiated out into the room in which the stove is used. The valves 16 are adjusted so as to control the amount of air flowing through vents 17 into the combustion chamber 18 to thereby control the temperature of the stove and the rate at which wood is consumed in the volatilization chamber 20.

Figure 4:
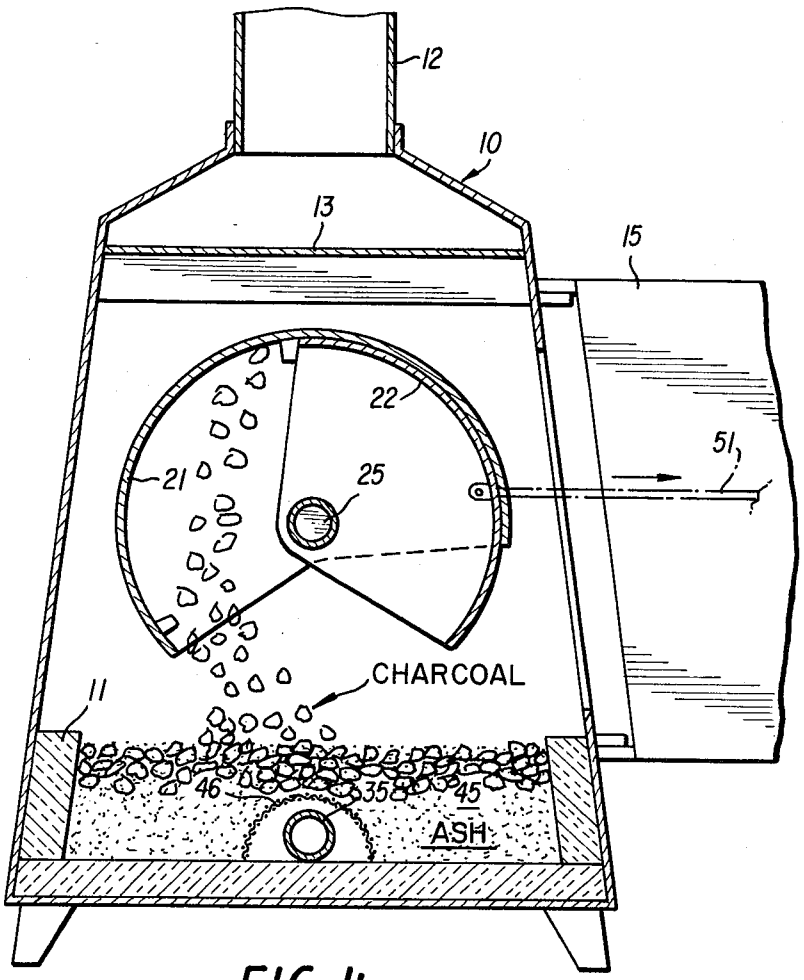
FIG. 4 is a front section, similar to FIG. 2, showing the volatilization chamber being tilted to dump residual charcoal therefrom into the combustion chamber of the stove.
Figure 3:
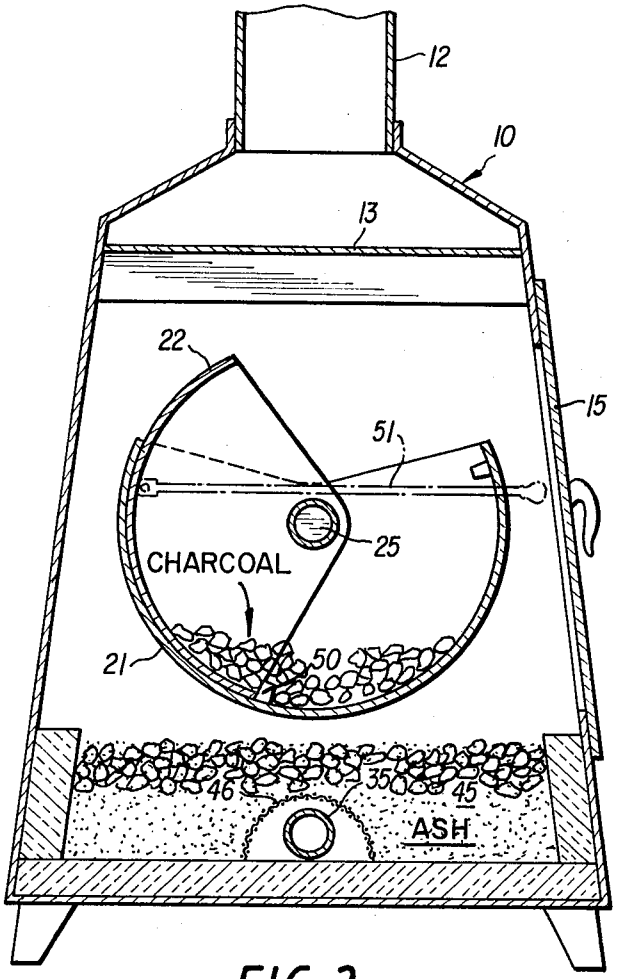
FIG. 3 is a front section, similar to FIG. 2, showing a volatilization chamber opened to receive firewood.

After the wood in the stove 20 is substantially reduced to charcoal by driving off all the volatiles, the door 15 to the stove 10 is opened and the cover 22 of the volatilization chamber 20 is rotated about axle 25 and pipe end 31 until the cover hits a stop 50, as is seen in FIG. 3. As is seen in FIG. 4, the receptacle 21 is then rotated by pulling on a link 51 in order to dump the charcoal in the receptacle onto the layer of solid fuel 45 so as to add unburned carbon to the solid fuel. The receptacle is then returned to the FIG. 3 position and wood is added to the receptacle for subsequent burning upon closing the cover 22 as is shown in FIG. 2. Accordingly, a method of burning wood is disclosed wherein the wood placed in the volatilization chamber 20 is first volatilized, the volatiles are burned to provide heat for the stove and for further volatilization and the charcoal remaining after volatilization is subsequently burned. By utilizing this method, all of the combustible material in the wood is consumed within the stove 10 instead of going up the chimney 12. Very little products of combustion other than water and carbon dioxide flow up the chimney 12 because all combustible volatiles are burned and there is no particulate matter driven from the wood. The creosote problem is minimized because the volatiles all burn in the combustion chamber 18 instead of flowing up the chimney 12 and condensing thereon.

The illustrated embodiment is merely one form the invention may take. The inention is limited only by the following claims:

What is claimed:

1. A wood-burning stove comprising:

a substantially closed first chamber for containing wood having volatiles to be driven therefrom in the absence of air;

a second chamber interfacing with the first chamber for combustion of the volatiles produced in the first chamber;

means for introducing air into the second chamber;

means for transmitting volatiles from the first chamber to the second chamber upon heating the first chamber by combustion in the second chamber wherein carbon containing residuals remain in the first chamber after the volatiles have been driven from the first chamber, said transmitting means being the only substantial connection between the interior of the first chamber and the second chamber during normal operation of the stove, and means for dumping the carbon-containing residuals remaining in the first chamber after burning wood therein into the second chamber, whereby when the first chamber is again loaded with wood heat, from the carbon-containing residuals helps drive volatiles from the wood, which volatiles are burned in the second chamber along with the carbon-containing residuals.

2. The wood-burning stove of claim 1 wherein the means for introducing air into the second chamber is adjustable to control the rate of combustion.

3. A wood-burning stove comprising:

a substantially closed first chamber for containing wood having volatiles to be driven therefrom in the absence of air, the first chamber having two sections, one section being rotatable with respect to the other section for opening the chamber to receive wood for subsequent volatilization and for dumping ashes from the chamber after the wood has been volitized;

a second chamber interfacing with the first chamber for combustion of the volatiles produced in the first chamber;

bearing means for rotatably mounting the first chamber in the second chamber whereby the first chamber can be rotated within the second chamber when dumping ashes from the first chamber into the second chamber;

means for introducing air into the second chamber, and means for transmitting volatiles from the first chamber to the second chamber upon heating the first chamber by combustion in the second chamber, said transmitting means being the only substantial connection between the interior of the first chamber and the second chamber during normal operation of the stove, said transmitting means further having a portion which is coaxial with the bearing means whereby the volatiles flow through the bearing means from the first chamber to the second chamber.

4. A woodburning stove comprising:

a first chamber means for containing wood having volatiles to be driven therefrom in the absence of air, said first chamber means including means for isolating the wood from oxygen while permitting volatiles to escape from the first chamber upon application of heat to the first chamber;

a second chamber interfacing with the first chamber and communicating with the means for isolating the wood from oxygen while permitting the volatiles to escape from the first chamber, wherein the heat applied to the first chamber is produced upon burning the volatiles in the second chamber;

means for introducing air into the second chamber whereby combustion of the volatiles produced in the first chamber occurs in the second chamber, leaving carbon containg residuals in the first chamber; and means for dumping the carbon-containing residuals remaining in the first chamber after burning wood therein into the second chamber, whereby when the first chamber is again loaded with wood, heat from the carbon-containing residuals helps drive volatiles from the wood, which volatiles are burned in the second chamber along with the carbon-containing residuals.

* * * * *